United States Patent [19]

Dalsbö

[11] Patent Number: 4,895,093

[45] Date of Patent: Jan. 23, 1990

[54] MANOEUVRING DEVICE FOR BOATS

[76] Inventor: Ola K. Dalsbö, Högreina 302, 7079 Flataasen, Norway

[21] Appl. No.: 223,070

[22] PCT Filed: Nov. 9, 1987

[86] PCT No.: PCT/NO87/00073

§ 371 Date: Jul. 20, 1988

§ 102(e) Date: Jul. 20, 1988

[87] PCT Pub. No.: WO88/03891

PCT Pub. Date: Jun. 2, 1988

[30] Foreign Application Priority Data

Nov. 20, 1986 [NO] Norway ..... 864628

[51] Int. Cl.[4] ..... B63H 5/14

[52] U.S. Cl. ..... 114/163; 114/166; 440/40; 440/43; 440/66

[58] Field of Search ..... 114/163, 166, 145 R, 114/145 A; 440/40, 41, 43, 66, 71

[56] References Cited

U.S. PATENT DOCUMENTS

| | | | |
|---|---|---|---|
| 1,186,210 | 6/1916 | Kitchen et al. . | |
| 1,549,564 | 8/1925 | Slocum . | |
| 2,155,112 | 4/1939 | Anderson | 114/145 A |
| 2,916,005 | 12/1959 | Parsons | 440/71 |
| 3,185,124 | 5/1965 | Spence | 440/43 |
| 3,226,033 | 12/1965 | Cochran | 440/41 |
| 3,824,946 | 7/1974 | MaCardy et al. | 440/43 |

FOREIGN PATENT DOCUMENTS

| | | | |
|---|---|---|---|
| 554985 | 6/1923 | France . | |
| 2033324 | 5/1980 | United Kingdom | 114/166 |

*Primary Examiner*—Sherman D. Basinger
*Assistant Examiner*—Thomas J. Brahan
*Attorney, Agent, or Firm*—Dennison, Meserole, Pollack & Scheiner

[57] ABSTRACT

The invention is a manoeuvring device for boats, comprised of a pair of pivotal tube plates (17, 18) mounted outside a propeller 14 and, under normal operation, forming a tube (19) around the propeller. These plates can be swung to one side relative to a medial position to enable sideways steering of the vessel, and be brought together astern of the propeller to form a blade when reversing. The tube plates (17, 18) extend down beneath the propeller (beside 19B). A tube wing (20), extending in a longitudinal direction, is mounted immediately beneath the propeller (14) and is arched upwards towards the propeller wings. Under normal operation, a tube that is sickle-shaped in cross section is delimited between the tube wing and the lower portion of the tube plates. The pivot axis of the tube plates (17, 18) is preferably located close to the propeller wing plane.

7 Claims, 1 Drawing Sheet

Fig. 1.
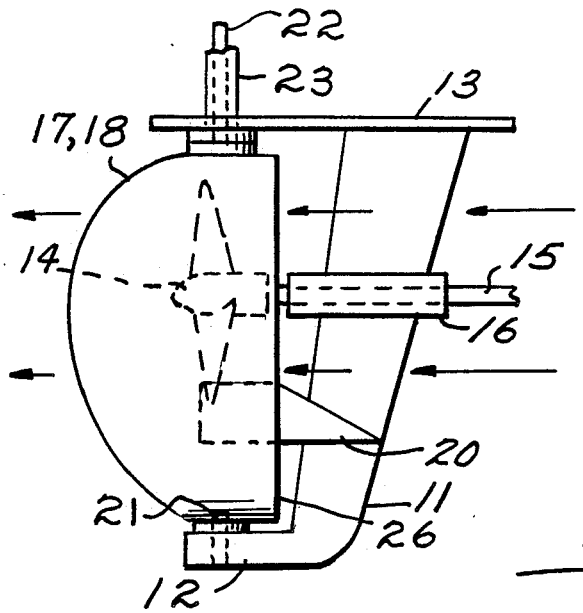
Fig. 2.
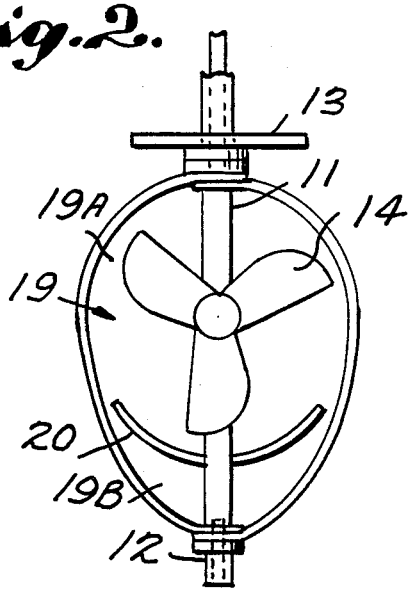
Fig. 4.
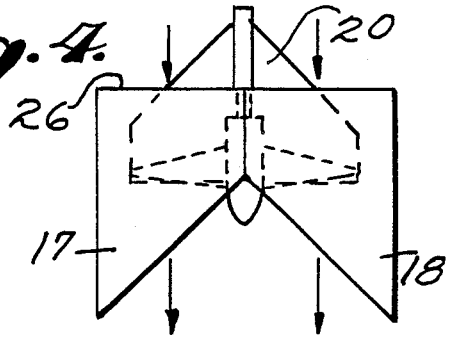
Fig. 3.
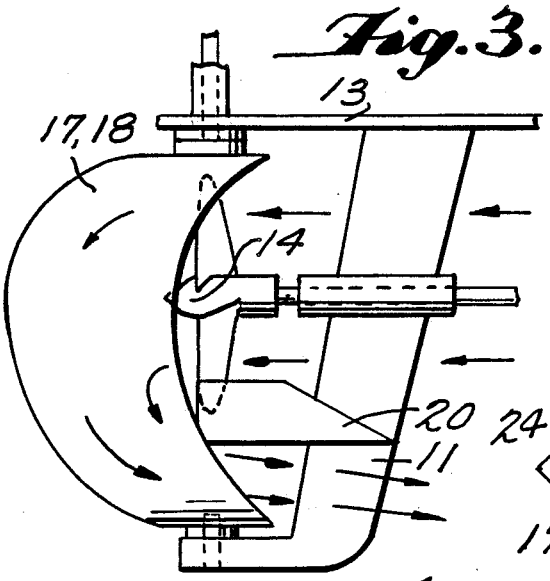
Fig. 5.
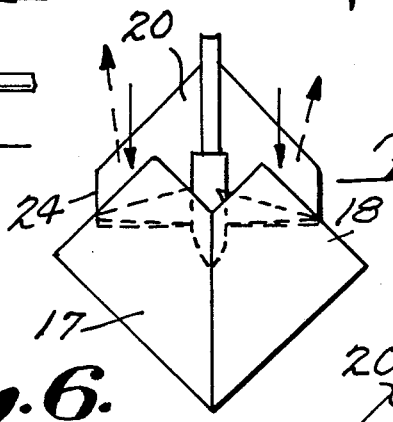
Fig. 6.
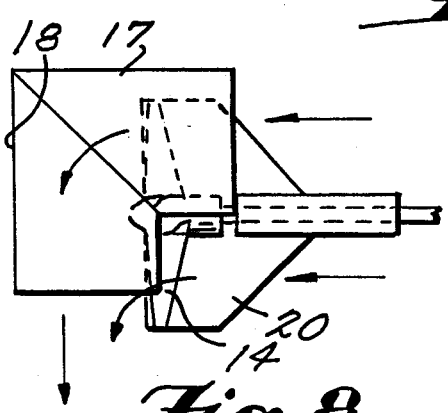
Fig. 8.
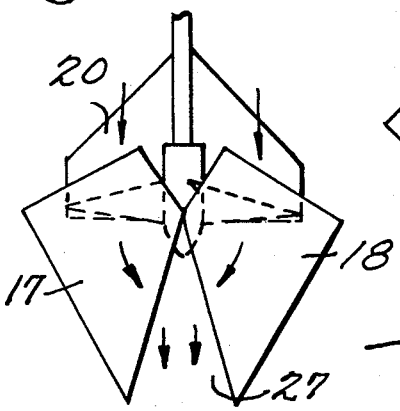
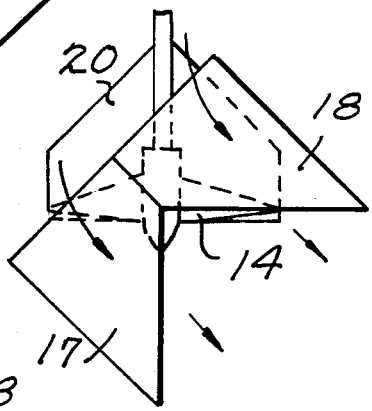
Fig. 7.

MANOEUVRING DEVICE FOR BOATS

BACKGROUND OF THE INVENTION

The invention concerns a manoeuvring device of the type described in the introduction to patent claim 1, for boats and other propeller-driven floating structures.

A manoeuvring device of this kind, the Kitchen rudder has been known since the 1920's. The Kitchen rudder has been burdened with substantial inconvenience making it unsuitable for practical use. It leads, for example, to turbulence developing between the plates, reducing the reversing effect when these are closed. In addition, the Kitchen rudder has had imprecise sideways manoeuvring effect.

Because of this, propeller speed, propeller pitch and side propellers are still commonly used manoeuvring aids, in addition to traditional rudders. This calls for expensive basic equipment and also demands extensive servicing and leads to unnecessarily high risk of failure.

OBJECT OF THE INVENTION

The main object of the invention is to create a manoeuvring device, particularly for boats, that is simpler in construction and operation than devices now in common use.

More precisely, the aim is to improve the already available manoeuvring device so than it functions satisfactorily under all operating situations.

Principle of the invention

The principle of the invention is defined in that part of patent claim 1 that describes its characteristic features.

Such manoeuvring device can satisfactorily replace conventional manoeuvring devices based on rudders. In certain situations, specified below, it also provides substantial operating advantages compared with these. The most important additional advantages it offers are simpler construction and a demand for less servicing and repair compared with those manoeuvring devices now in common use.

Additional advantageous features of the invention are mentioned in the dependent patent claims.

EXAMPLE

The invention is described more fully below, reference being made to the drawings, where:

FIGS. 1, 2 and 4 show, respectively, side elevation, rear elevation and a simplified view from above of a version of the invention in motion straight ahead, FIGS. 3 and 5 show, respectively, side elevation and a simplified view from above of the version chosen, during braking and reversing, whilst FIGS. 6–8 show views from above of the tube plates in various operating situations.

In FIGS. 1 and 2 a bracket 11 is shown, which can be constructed as part of the boat hull (not illustrated), or be secured to that. The bracket has the form of an arm of metal plate directed steeply downwards and backwards. A horizontal, backwards-directed, supporting arm 12 is secured to the lower edge, whilst a horizontal supporting plate 13, e.g. with parallel sides, is mounted to the top and can function as a cavitation plate to prevent air being sucked down to a propeller 14 when the distance to the water surface is short.

The propeller 14 is secured to a propeller shaft 15 supported in a sleeve 16 fixed to the bracket 11. The propeller 14 may have a fixed pitch and rotational speed.

As a main active feature of the manoeuvring device a punch guide plate, respectively 17 and 18, is mounted on either side of the propeller 14, and this is referred to in the following as a tube plate. In cross section the tube plates 17 and 18 describe a circular-arched profile in their upper halves, adjusted to the diameter of the propeller, and an almost parabolic profile in their lower halves, because together the plates form a laterally enclosed duct or tube 19.

In the tube 19, and beneath the propeller 14, is a arched wing 20, called in the following a tube wing, that is located medially and follows the curvature of the upper halves of the tube plates 17 and 18. The tube wing 20 divides the tube 19 into an upper part 19A that is circular in cross section and a lower part 19B with sickle-shaped or crescent-shaped cross section. These distinguishing geometrical shapes relate to the operating situation illustrated in FIGS. 1, 2 and 4.

At their lower edges the tube plates 17 and 18 are mounted on the supporting arm 12 using a shaft journal 21 going through overlapping holes in the margin of the tube plates, optionally using friction-reducing linings. At its upper edge one tube plate 17 is fixed to a upwards protruding rudder spindle 22, whilst the other is secured to another, tubular, rudder spindle 23 placed concentrically to the first one. These two rudder spindles 22 and 23 are run through a supporting plate 13 and up through a rudder sleeve (not shown). The mounting of the rudder spindles and the construction of a turning mechanism to swing the tube plates 17 and 18 in the manner described below can be based on known engineering.

The tube wing 20 is fastened to the bracket 11 in such a way that it extends back to the propeller wing plane. It has edges 24 (FIG. 5) extending forwards as far as the swinging of the tube plates allows, as illustrated, for example, in FIG. 7. From there it tapers forwards to the leading edge of the bracket 11. The tube wing 20 is welded or screwed to the bracket.

The tube plates 17 and 18 terminate forwards with a flat edge 26 about one-half propeller radius of the wing plane. Backwards the tube plates are terminated by an edge that is shaped to correspond with the common line of intersection between the plane of the two tube plates and a longitudinal medial plant through the pivot axis of the tube plates, so that they meet each other closely when they swing together.

The rudder spindles 22 and 23, together with the lower bearing pin 21 which defines the pivot axis of the tube plate, lie in a vertical axis extending almost as far as the propeller wing plane.

FIGS. 3 and 5 illustrate an operating position for the manoeuvring device that is used to stop a boat that is moving forwards, and make it reverse. Here, the tube plates 17 and 18 are swung together at their rear edges to form an enclosing blade behind the propeller 14. In vertical section this blade has an arched profile and extends down to the lower edge of the bracket 11. When the propeller 14 is operating, water streaming rearwards through the tube 19A will be directed downwards by the blade created by the swinging together of tube plates 17 and 18, and be pressed forwards through the tube 19B. A forward-moving water current is thus created stopping the vessel. Because of the shape of the tube plates 17 and 18, the use of the tube wing 20 and the positioning of the manoeuvring device relative to the wing plane, no interfering turbulence will be created in the turning area. The normal motive thrust of the propeller will therefore be effectively transformed into a reversing thrust.

FIG. 6 shows an operating situation where the tube plates 17 and 18 are swung partially together. This leaves a narrow space 27 between them, leading to reduced motive thrust ahead compared with when the tube 19 is fully open as in FIG. 4. Variations in the space 27 can replace regulating the pitch and/or rotation of the propeller. This enables the thrust to be regulated and the boat to be turned using substantially simpler steering equipment.

FIG. 7 illustrates an operating situation where both tube plates 17 and 18 are turned about 45° in the same direction relative to motion straight ahead. This swings the driving current diagonally rearwards thereby steering the vessel to the same side.

FIG. 8 illustrates an operating situation where the one tube plate 18 is turned 90° towards the other in relation to the position in FIG. 4. Hence, the one tube plate 17 will remain in the usual operating position, parallel with the vessel, whilst the other will be placed transverse to the first and therefore abeam the direction in which the vessel is moving, behind the propeller 14. This leads to the water current from the propeller 14 being directed transverse to the vessel, giving sideways thrust. Thus, the manoeuvring device, in accordance with the invention, can replace a side propeller.

The manoeuvring device described above is, in addition, equipped with a steering system for the (not illustrated) manoeuvring mechanism. Such a steering system can be constructed in a manner that is, in principle, known, and can be made substantially simpler than those steering systems that are required to regulate propeller pitch, propeller speed, driving direction and possible operation of a side propeller.

I claim:

1. In a manoeuvring device for a boat and the like having a propulsion means (14) for developing a rearwardly directing stream of water for a reactive forward driving of the boat and the like, a pair of vertically elongate, transversely arced, pivotal tube plates (17, 18), one mounted to each side of the propulsion means and in the normal operating position thereof forming a tube around the propulsion means, said tube plates being mounted for swinging movement to bring the tube plates together along adjoining edges astern of and spaced from the propulsion means to form a blade for interrupting and diverting the rearwardly directed stream of water, the improvement wherein the tube plates extend downward below the propulsion means, and a tube wing (20) positioned transversely between the tube plates immediately under the propulsion means, said tube wing extending in the longitudinal direction and being transversely arced upward toward the propulsion means, said tube wing delimiting a passageway (19B), below and separate from the propulsion means and the rearwardly directed stream of water, for receiving and forwardly directing the diverted stream of water.

2. The manoeuvring device of claim 1, wherein the passageway below the propulsion means is crescent-shape in cross-section.

3. The manoeuvring device of claim 2, wherein said tube plates are pivotally joined, along a common axis, above said propulsion means and in spaced relation below said tube wing.

4. The manoeuvring device of claim 3, wherein said propulsion means comprises a propeller.

5. The propulsion means of claim 4, wherein the axis on which the tube plates are pivotally joined is generally aligned with said propeller.

6. The manoeuvring device of claim 5, wherein said tube plates, in the normal operating position thereof, extend forward of the propeller a distance equal to approximately one-half the radius of the propeller.

7. The manoeuvring device of claim 5, wherein said tube wing includes a rear edge generally aligned with the propeller, and a forward edge in forwardly spaced relation to said propeller.

* * * * *